US009153895B2

(12) United States Patent
Kao et al.

(10) Patent No.: US 9,153,895 B2
(45) Date of Patent: Oct. 6, 2015

(54) ELECTRICAL CONNECTOR PLUG HAVING A METALLIC SHIELD CONNECTED TO AN ELECTRICALLY CONDUCTIVE HOUSING OF THE PLUG

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/285,618

(22) Filed: May 22, 2014

(65) Prior Publication Data

US 2015/0111425 A1 Apr. 23, 2015

(30) Foreign Application Priority Data

Oct. 18, 2013 (TW) ..... 102137774 A

(51) Int. Cl.

| | |
|---|---|
| ***H01R 13/658*** | (2011.01) |
| ***H01R 13/504*** | (2006.01) |
| ***H01R 13/6581*** | (2011.01) |
| ***H01R 13/6597*** | (2011.01) |
| ***H01R 24/62*** | (2011.01) |

(52) U.S. Cl.
CPC ..... *H01R 13/504* (2013.01); *H01R 13/6581* (2013.01); *H01R 13/6597* (2013.01); *H01R 13/65802* (2013.01); *H01R 24/62* (2013.01)

(58) Field of Classification Search
USPC ..... 439/607.01–607.59
See application file for complete search history.

(56) References Cited

U.S. PATENT DOCUMENTS

| | | | | |
|---|---|---|---|---|
| 2010/0068903 | A1* | 3/2010 | Chiang et al. | 439/79 |
| 2010/0278490 | A1* | 11/2010 | Liao et al. | 385/90 |
| 2015/0072557 | A1* | 3/2015 | Kamei et al. | 439/607.02 |
| 2015/0072565 | A1* | 3/2015 | Golko et al. | 439/676 |
| 2015/0111425 | A1* | 4/2015 | Kao et al. | 439/607.01 |

* cited by examiner

*Primary Examiner* — Chandrika Prasad

(57) ABSTRACT

An electrical connector plug having resilient contact terminals electrically connects to an electrical connector socket with a casing and two groups of engaging terminals mounted on or in the casing. The electrical connector plug has an electrically conductive housing. A coupling device extends in a longitudinal direction and has a base portion. Two groups of resilient contact terminals are mounted in the coupling device axially symmetrically arranged with each other in the longitudinal direction, each of which has a flat section and an upwardly protruding contact section. A metallic shield frame is electrically connected to and secured to the electrically conductive housing, having a frame section, a front section, and two lateral protective sections. An electrically conductive section extends from the frame section towards the front section for electrical connection to the casing of the electrical connector socket.

9 Claims, 9 Drawing Sheets

ELECTRICAL CONNECTOR PLUG HAVING A METALLIC SHIELD CONNECTED TO AN ELECTRICALLY CONDUCTIVE HOUSING OF THE PLUG

FIELD OF THE INVENTION

The present invention relates to an electrical connector plug and conductive wire and an assembly provided with the same, and more particularly, to an electrical connector plug adapted for the Universal Serial Bus (USB) interface.

BACKGROUND OF THE INVENTION

To increase the flexibility of 3C products (computers/communications/consumer products), various external devices can be connected using multi-media slots provided on the 3C products, to support devices such as external hard drives, portable disks or memory sticks (collectively referred to herein as USB drives), multi-media video & audio equipment, keyboards and so forth, so as to functional expansion of the 3C product. However, when 3C products initially came to rise, manufacturers designed various proprietary specifications for the transmission or communication interfaces for their own external devices. For example, many printers can only be connected to LPT ports, many MODEMs can only be connected to RS232 ports, certain types of mice and keyboards can only be connected to PS/2 ports, and so on. Moreover, different interface specifications require the installation of corresponding drivers and then rebooting the 3C products prior to use. Consequently, the external device must be compatible with the transmission interface of the 3C product. This can be the source of great inconvenience for the user. In addition, this introduces manufacturing difficulties for 3C product developers and accessory manufacturers. The USB interface supports the convenient features of hot swapping and plug-and-play. This means that 3C products can be plugged/unplugged without powering off, which will not damage the host or USB device. Moreover, the USB protocol supports detection and use of newly plugged-in external devices in real time. Additionally, USB transmission speeds are much higher than those of traditional standard buses, such as a parallel ports (e.g. EPP, LPT) and serial ports (e.g. RS-232). Therefore, the USB interface has now become a popular and widely accepted specification.

To date, the development of the USB technology has gone through three major phases, from 1.0 to 3.0, and it is somewhat troublesome to change and maintain the USB socket built into the computer host. The USB 3.0 plug provides an engaging terminal on both sides. Inserted in either way, it can be electrically connected to the socket, which improves upon conflicting structural design on both sides. In this way, USB 3.0 expects to provide a more fool-proof design and avoid the damage of USB sockets due to a user's incorrect plugging or over-forcing of the plug. According to the current design, the electrically conductive terminals in the USB socket have a resilient structure. After the USB plug is connected to the socket, the resilient electrically conductive terminals in the USB socket are pressed back by the engaging terminals of the USB plug, and elastically abut against the engaging terminals. In this way, the electrical connection between the USB socket and USB plug is kept stable.

However, the resilient electrically conductive terminals may suffer from elastic fatigue, over-forcing or over-displacement, which can interrupt the electrical connection between the contact terminals and the resilient electrically conductive terminals. Powered-off or short-circuited USB device obviously cannot work effectively, which is, again, a source of great inconvenience to users. Moreover, many external devices are used collaboratively, such as multi-media video & audio equipment, keyboard and external hard drives, which must work together. In case of malfunction of the USB socket, users must resort to plugging and unplugging the external device again and again to maintain operations. Worse, this repeated plugging/unplugging operation may damage the external device more easily, and so users should be more cautious. To maintain a convenient and hassle-free use, most users choose to change to a new USB socket. However, it is quite difficult for users to change the USB socket by themselves, which typically requires disassembling the 3C product and checking the motherboard. For most common users, who are unfamiliar with the internal structure of 3C products, they can only return the product to the manufacturer to change the USB socket, and this may take several days. Nowadays, people rely on 3C products so much that they may become annoyed if so much time is wasted on a small component, which introduces unwanted delays in their work or entertainment.

Because of the maintenance inconvenience related to USB sockets, manufacturers place a great emphasis on protecting them. With the current trend in which all electronic gadgets are made light, slim, short and small, the USB 3.0 is more compact than the previous USB 1.0 and 2.0, and looks like a mini or micro USB port. Yet, the number of terminals in USB 3.0 greatly exceed that of mini USB and micro USB. Unavoidably, the resilient electrically conductive terminals of USB 3.0 are still the core components susceptible to damage.

Additionally, to achieve good electrical connection, shielding and grounding effects between the USB socket and USB plug, some manufacturers process the shell of the USB plug to bend it. This helps to strengthen the coupling between the USB socket and USB plug, and achieves the effect of shielding crosstalk between the terminals of these two elements. However, the overall structure of USB 3.0 is quite delicate, and so it is both time and energy consuming to do this on the delicate structure of a USB 3.0 device for the above purpose, which increases unnecessary manufacturing costs.

SUMMARY OF THE INVENTION

Various embodiments of the invention provide an electrical connector plug and conductive wire and an assembly provided with the same. Such embodiments prevent the resilient contact terminals from becoming a point of weakness in a USB socket, protecting and supporting the resilient contact terminals, so as to prevent structural damage due to excessive pressure. Various embodiments reduce the probability of malfunction related to contact terminals. Even if they are damaged, the user can easily change them, so as to save time and effort wasted by returning a device to the manufacturer for maintenance.

Another aspect is to provide an electrical connector plug and conductive wire and an assembly provided with the same, which mounts the vulnerable resilient electrically conductive terminals on a USB plug to solve the problems of existing device, such as repair difficulties and resultant wasted time.

Another objective of various embodiments is to provide an electrical connector plug and conductive wire and an assembly provided with the same, which adds a metallic shield frame on the USB plug to provide additional protection for the vulnerable contact terminals. Excessive external force is absorbed by the metallic shield frame, so as to reduce the probability of damaging the structure of the contact terminals.

Another aspect provides an electrical connector plug and conductive wire and an assembly provided with the same, which adds a metallic shield frame to a USB plug to provide crosstalk protection.

Yet another aspect is to provide an electrical connector plug and conductive wire and an assembly provided with the same, wherein the shell of the USB plug that typically goes through a bending process for several times is replaced by an electrically conductive section extending from the frame section of the metallic shield frame formed by casting, so as to reduce the manufacturing costs of the USB plug.

To achieve the above purposes, various embodiments provide an electrical connector plug with resilient contact terminals adapted for an electrical connection socket, wherein the electrical connector socket includes a casing and at least two groups of engaging terminals connected to the casing. The electrical connector plug includes an electrically conductive housing and a coupling device mounted on the electrically conductive housing and extending in a longitudinal direction, the coupling device having a base portion. At least two groups of resilient contact terminals are mounted on the coupling device axially symmetrically arranged with each other in the longitudinal direction. Each of the resilient contact terminals has a flat section secured at least in part in the base portion of the coupling device and an upwardly protruding contact section extending from and bending towards the flat section. The flat sections are parallel to one another and the respective upwardly protruding contact sections are adapted to abut against a corresponding one or more of the engaging terminals of the electrical connector socket. A metallic shield frame is electrically connected to and secured to the electrically conductive housing, with the metallic shield frame comprising a frame section, a front section, and two lateral protective sections respectively extending from two ends of the front section and connected to the frame section. The respective lateral protective sections have a height no less than that of the upwardly protruding contact sections of the resilient contact terminals. An electrically conductive section extends from the frame section towards the front section that is adapted for electrical connection to the casing of the electrical connector socket.

Various embodiment electrical connector plugs can be connected to at least one end of a connecting wire, namely, a conductive wire, which is for electrical connection to an electrical connector socket comprised a casing and at least two groups of engaging terminals coupled to the casing. The conductive wire has at least one electrical connector plug, and a wire electrically connected to the electrical connector plug. The electrical connector plug includes an electrically conductive housing, and a coupling device coupled to the electrically conductive housing and extending along a longitudinal direction and having a base portion. Two groups of resilient contact terminals are mounted on the coupling device and are axially symmetrical to each other in the longitudinal direction. Each of the resilient contact terminals has a flat section secured at least in part in the base portion of the coupling device and an upwardly protruding contact section extending from and bending towards the flat section, wherein the flat sections are parallel to one another and the respective upwardly protruding contact sections are adapted to abut against a at least one corresponding engaging terminal of the electrical connector socket. A metallic shield frame is electrically connected to and secured to the electrically conductive housing, with the metallic shield frame including a frame section, a front section, and two lateral protective sections extending from two respective ends of the front section and connected to the frame section. The respective lateral protective sections each have a height no less than that of the upwardly protruding contact sections of the resilient contact terminals. An electrically conductive section extends from the frame section towards the front section and is adapted for electrical connection to the casing of the electrical connector socket.

The electrical connector plug together with the socket provides an electrical connector assembly, which includes an electrical connector socket having a casing and at least two groups of engaging terminals coupled to the casing, and an electrical connector plug electrically connected to the electrical connector socket. The connector plug includes an electrically conductive housing, and a coupling device coupled to the electrically conductive housing and extending in a longitudinal direction and having a base portion. Two groups of resilient contact terminals are mounted on the coupling device and are axially symmetrical to each other in the longitudinal direction, with each of the resilient contact terminals comprised of a flat section secured at least in part in the base portion of the coupling device and an upwardly protruding contact section extending from and bending towards the flat section. The flat sections are parallel to one another and the respective upwardly protruding contact sections are adapted to abut against a corresponding one or more of the engaging terminals of the electrical connector socket. A metallic shield frame is electrically connected to and secured to the electrically conductive housing, with the metallic shield frame comprising a frame section, a front section, and two lateral protective sections respectively extending from two ends of the front section and connected to the frame section. The respective lateral protective sections have a height no less than that of the upwardly protruding contact sections of the resilient contact terminals. An electrically conductive section extends from the frame section towards the front section and is adapted for electrical connection to the casing of the electrical connector socket.

Various embodiments of the electrical connector plug, conductive wire and assembly provided with the same mount the resilient electrically conductive terminals on the USB plug, and provide a metallic shield frame formed by metallic casting to support resilient contact terminals, thus preventing elasticity loss due to excessive pressure. Moreover, it replaces the electrically conductive lip that typically must go through a bending process several times, strengthening the electrical connection between the USB plug and the USB socket, and also reduces manufacturing costs. In this way, various embodiments provide additional protection for the resilient contact terminals on the USB plug, so that they are not easily damaged. Even if the resilient contact terminals are damaged, the user does not have to take the host device in for repair, but just needs to change the spare USB accessories, or even the conductive wire only. In this respect, the structure improves upon a serious drawback of the prior art USB socket and increases its durability, eliminating the trouble of repair by the manufacturer for the users.

BRIEF DESCRIPTION OF THE DRAWINGS

The foregoing and other features and advantages of illustrated embodiments of the present invention will be more readily apparent from the following detailed description, which proceeds with reference to the accompanying drawings.

DETAILED DESCRIPTION OF THE ILLUSTRATED EMBODIMENTS

Figure 1:
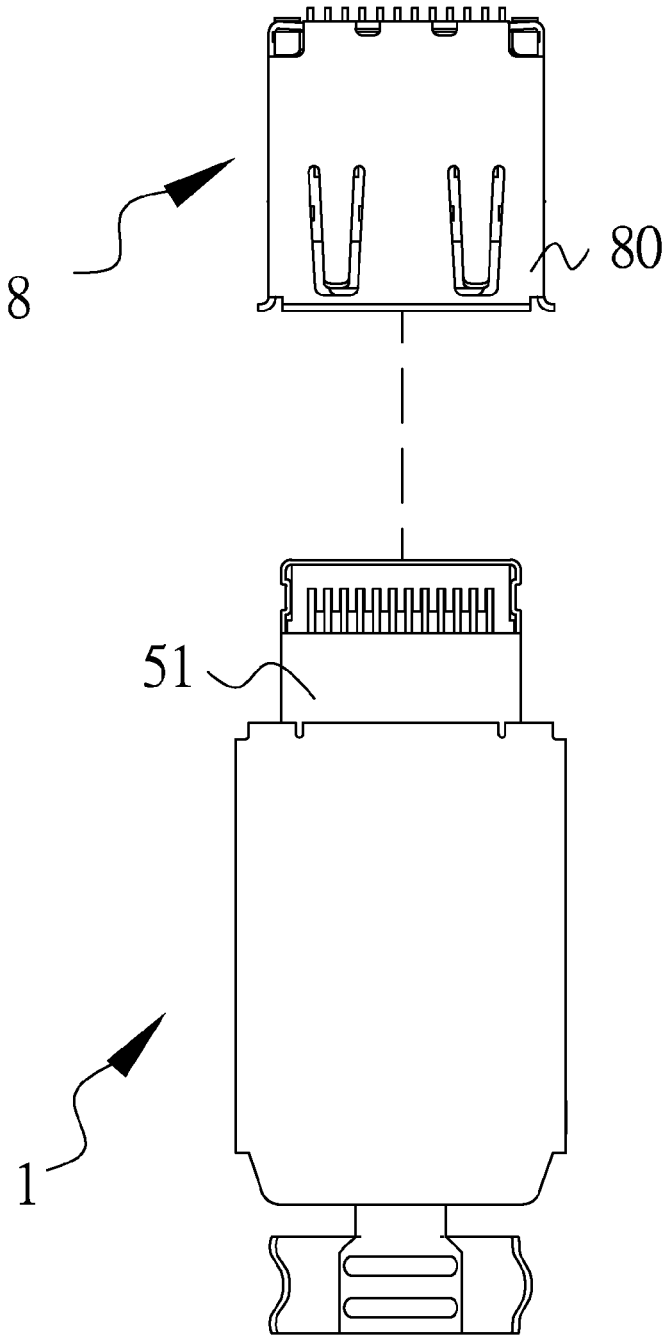
FIG. 1 is the schematic diagram of an electrical connector plug and conductive wire, and an assembly provided with the same, according to a first embodiment of the invention.
Figure 2:
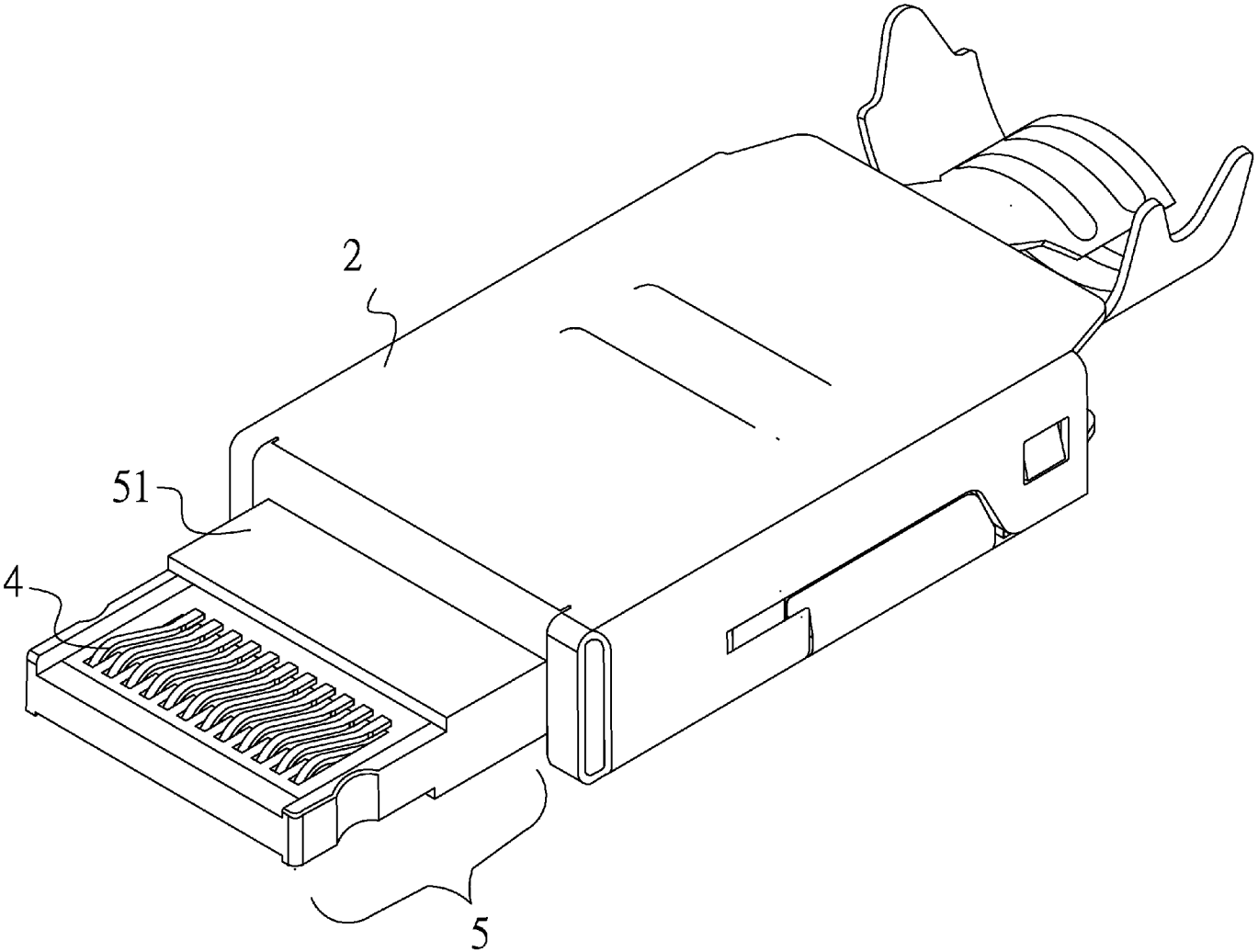
FIG. 2 is perspective view of the electrical connector plug shown in FIG. 1.
Figure 3:
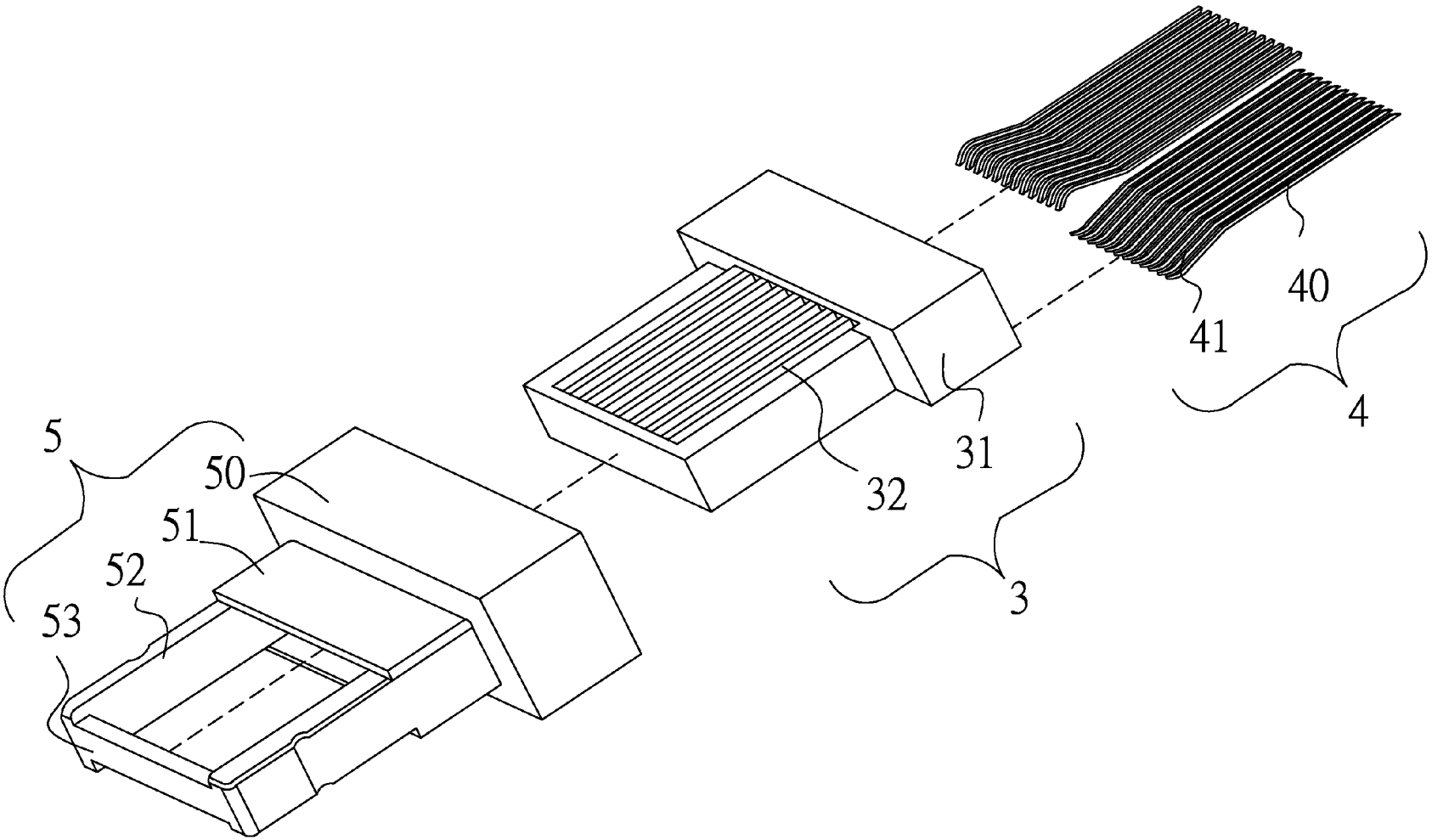
FIG. 3 is an exploded view of the electrical connector plug shown in FIG. 1.

The above statements related to the invention, other technical contents, features and benefits will be clearly presented in the detailed illustration for the preferred embodiments as shown in the diagrams. Additionally, similar assemblies in these embodiments will be represented by similar symbols.

A first embodiment utilizes an electrical connector assembly as an example, as shown in FIGS. 1-6. The electrical connector assembly is a USB connector assembly in this embodiment, comprised of an electrical connector socket 8 which is a USB socket and an electrical connector plug 1 which is a USB plug. An electrically conductive section 51 extends from the frame section 50 of the metallic shield frame 5 towards the front section 53, and is adapted for electrical connection to the casing 80 of the electrical connector socket 8. When the electrical connector plug 1 is coupled to the electrical connector socket 8, their metallic materials are electrically connected. The electrical connector socket 8 can be mounted on the shell or housing of various 3C products, to connect to the motherboard of the 3C products. The resultant electrical connection between the electrically conductive section 51 and the shell of the 3C products can provide grounding and shielding effects. In this way, the electrical signal transmitted by the terminals between the electrical connector socket 8 and the electrical connector plug 1 are not easily impacted by external electromagnetic radiation.

Figure 4:
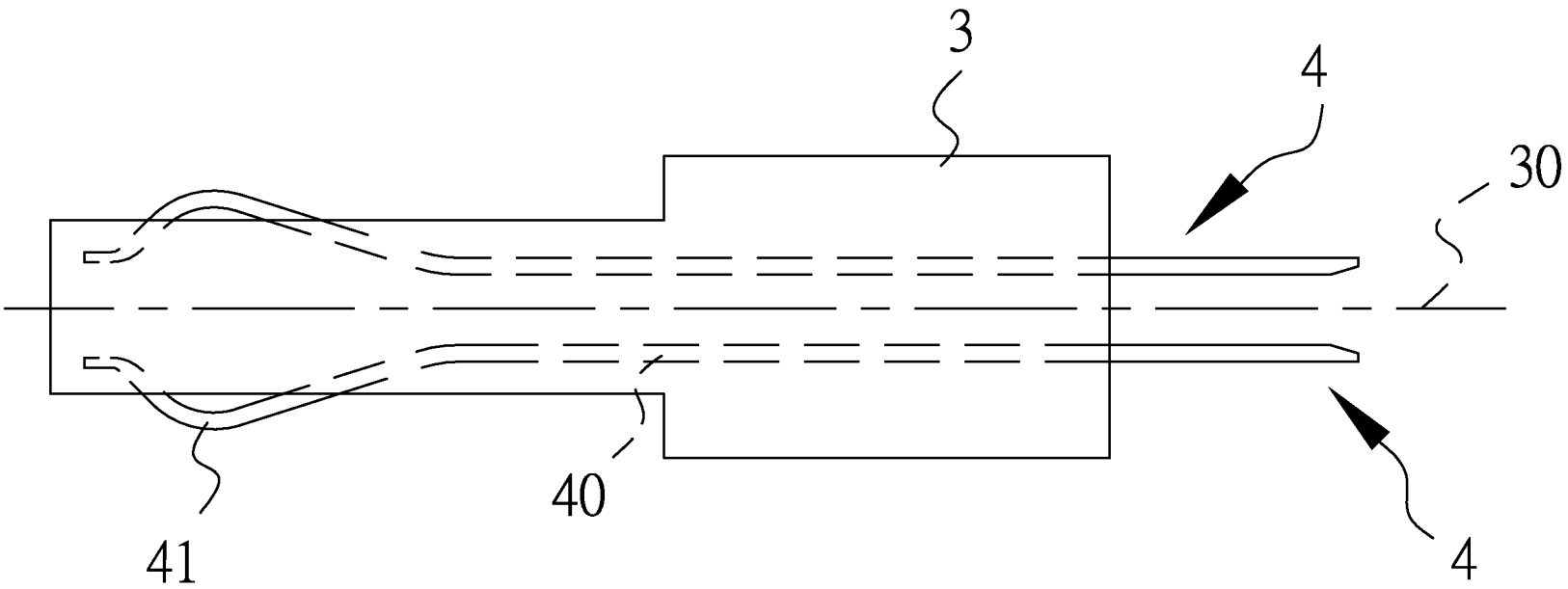
FIG. 4 is a side view of an electrical connector plug, illustrating resilient contact terminals of an embodiment USB 3.0 connector.
Figure 5:
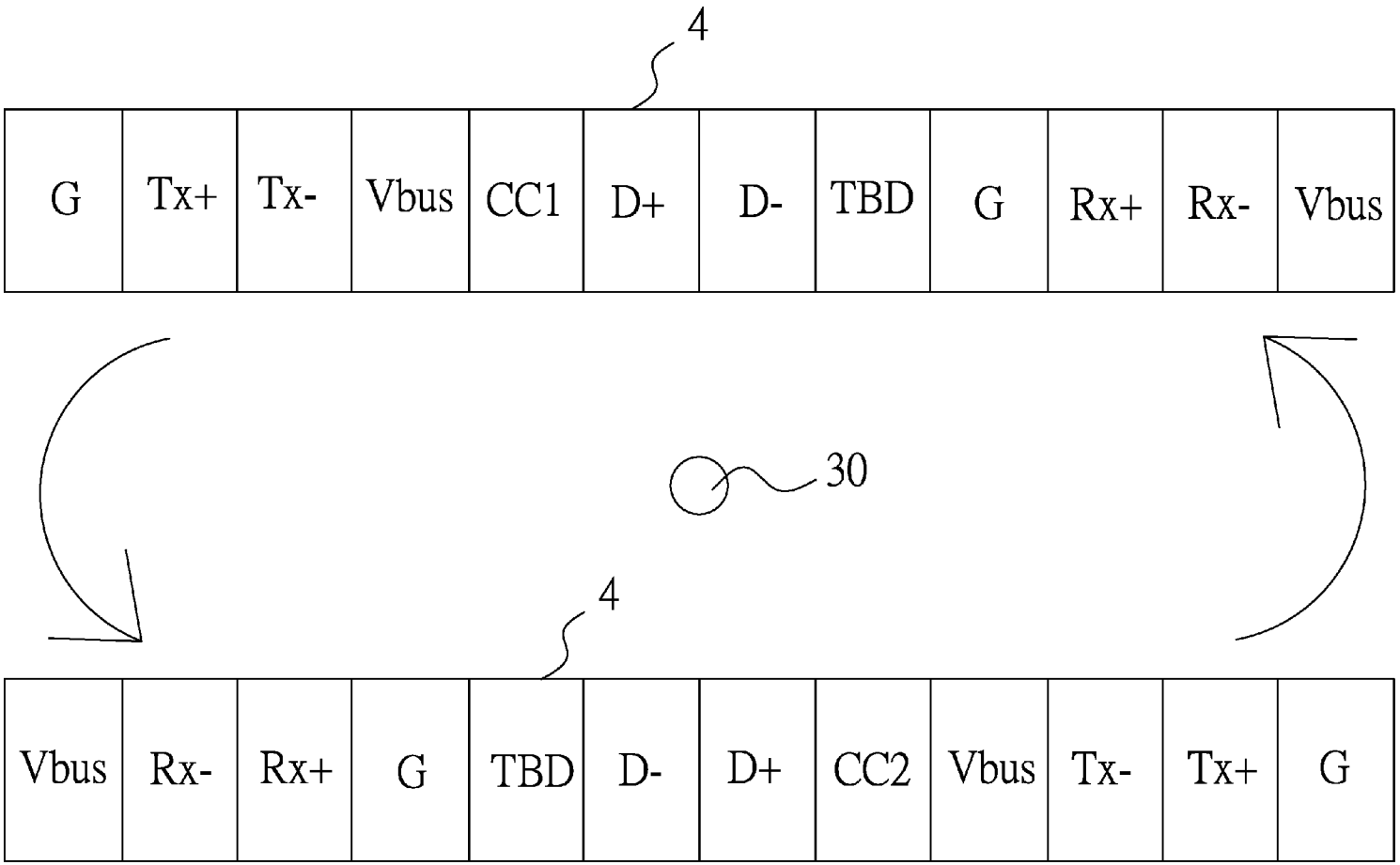
FIG. 5 is a front view of embodiment resilient contact terminals, illustrating an axially symmetrical arrangement of the resilient contact terminals.
Figure 6:
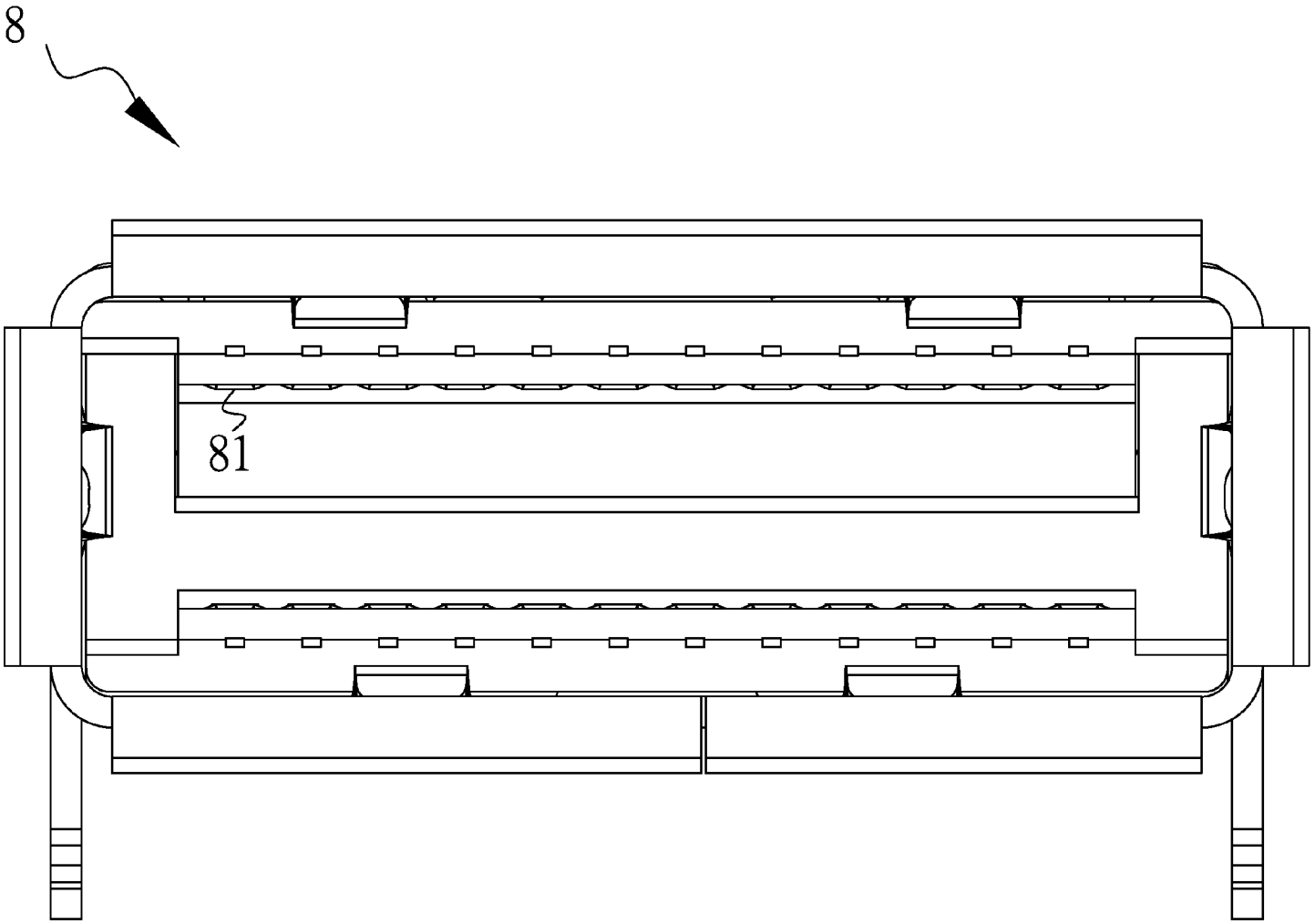
FIG. 6 is a front view of an embodiment electrical connector socket.

The electrical connector plug 1 is comprised of a coupling device 3 that extends along a longitudinal direction 30 and which is mounted in the electrically conductive housing 2. As shown in FIG. 4, there are two groups of resilient contact terminals 4, with the longitudinal direction 30 as the central axis, which are mounted on the coupling device 3. As shown in FIG. 5, the two groups of secured resilient contact terminals 4 are symmetrical to one another, wherein either group of resilient contact terminals 4 will be completely overlapped with another group by rotating 180 degrees, using the lateral longitudinal direction 30 as a pivot. For the purposes of clarity herein, the term axial symmetry along the longitudinal direction 30 is used to define the mounting positions of the two groups of resilient contact terminals 4.

The resilient contact terminals 4, which are axially symmetrical to one another, are mounted on the coupling device 3. Each of the resilient contact terminals 4 includes a flat section 40 and an upwardly protruding contact section 41 extending from and bending towards the flat section 40. The coupling device 3 comprises a base portion 31 and a plurality of guide grooves 32 formed in the base portion 31. The flat sections 40 of the resilient contact terminals 4 are secured in part on the base portion 31. The plurality of guide grooves 32 are used to receive the flat sections 40 of the resilient contact terminals 4, so as to prevent crossing of the flat sections 40 that might otherwise cause electrical shorting.

The metallic shield frame 5 in the electrical connector plug 1 includes two lateral protective sections 52 respectively extending from two ends of the front section 51 towards the frame section 50. The frame section 50, the front section 51, and these two lateral protective sections 52 can reduce the probability of electromagnetic interference between different connectors. The sidewall protective sections 52 of the metallic shield frame 5 have a height no less than that of the front section 51, and the height of the front section 51 is also lower than that of the upwardly protruding contact sections 41 of the resilient contact terminals 4.

When the electrical connector plug 1 is connected to the electrical connector socket 8, the engaging terminals 81 of the electrical connection socket 8 pass through the front section 51 with a lower height, so as to abut against and electrically connect with the resilient contact terminals 4 of the electrical connector plug 1. In case of over-forcing by a user, the resilient contact terminals 4 may be damaged during the plug/unplug process of electrical connector plug 1. However, because of the lateral protective sections 52 of the metallic shield frame 5, whose height is not less than that of the upwardly protruding contact sections 41 of the resilient contact terminals 4, the excessive force will be absorbed by the lateral protective sections 52, so it will not further press upon the resilient contact terminals 4, thus preventing damage of the resilient contact terminals 4 due to elastic fatigue.

The above structure transfers the vulnerable resilient contact terminals to the electrical connector plug, and will not have great impact on the electrical connection between the electrical connector plug and the electrical connector socket. It is less costly to change an electrical connector plug than an electrical connector socket. The resilient contact terminals are thus changed into consumable parts, which can be changed by the user in case they become damaged. In this way, the user does not have to wait a long time for repair of the host device. Additionally, the electrically conductive section extending from the frame section of the metallic shield section, which can be formed by casting, is to electrically connect with the casing of the electrical connector socket, thereby reducing the probability of crosstalk between the engaging terminals and the resilient contact terminals, and also saving manufacturing costs of the USB plug.

Figure 7:
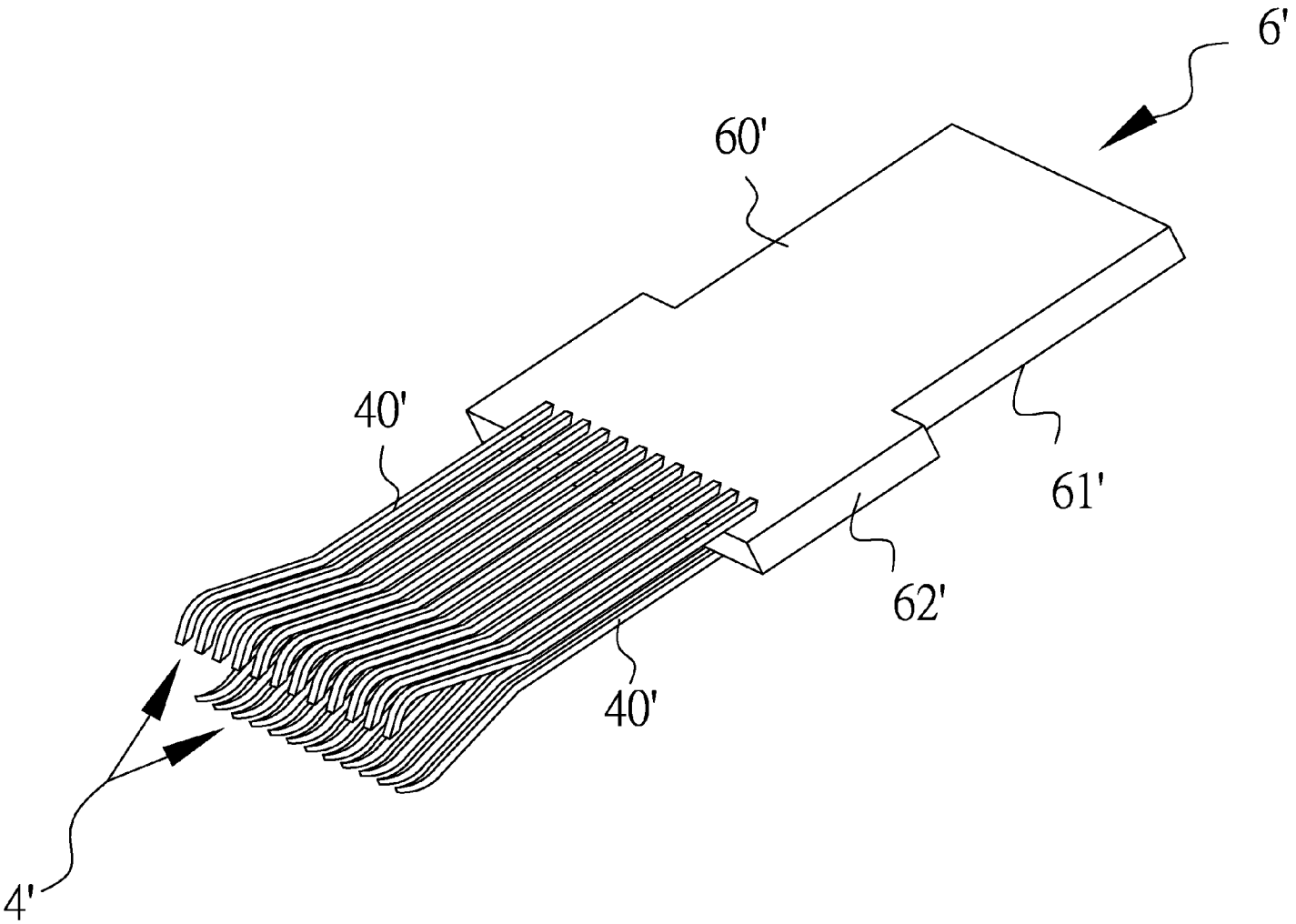
FIG. 7 is a perspective view of an electrical connector plug and conductive wire, and an assembly provided with the same, according to a second embodiment of the invention, illustrating resilient contact terminals welded to a circuit board.
Figure 8:
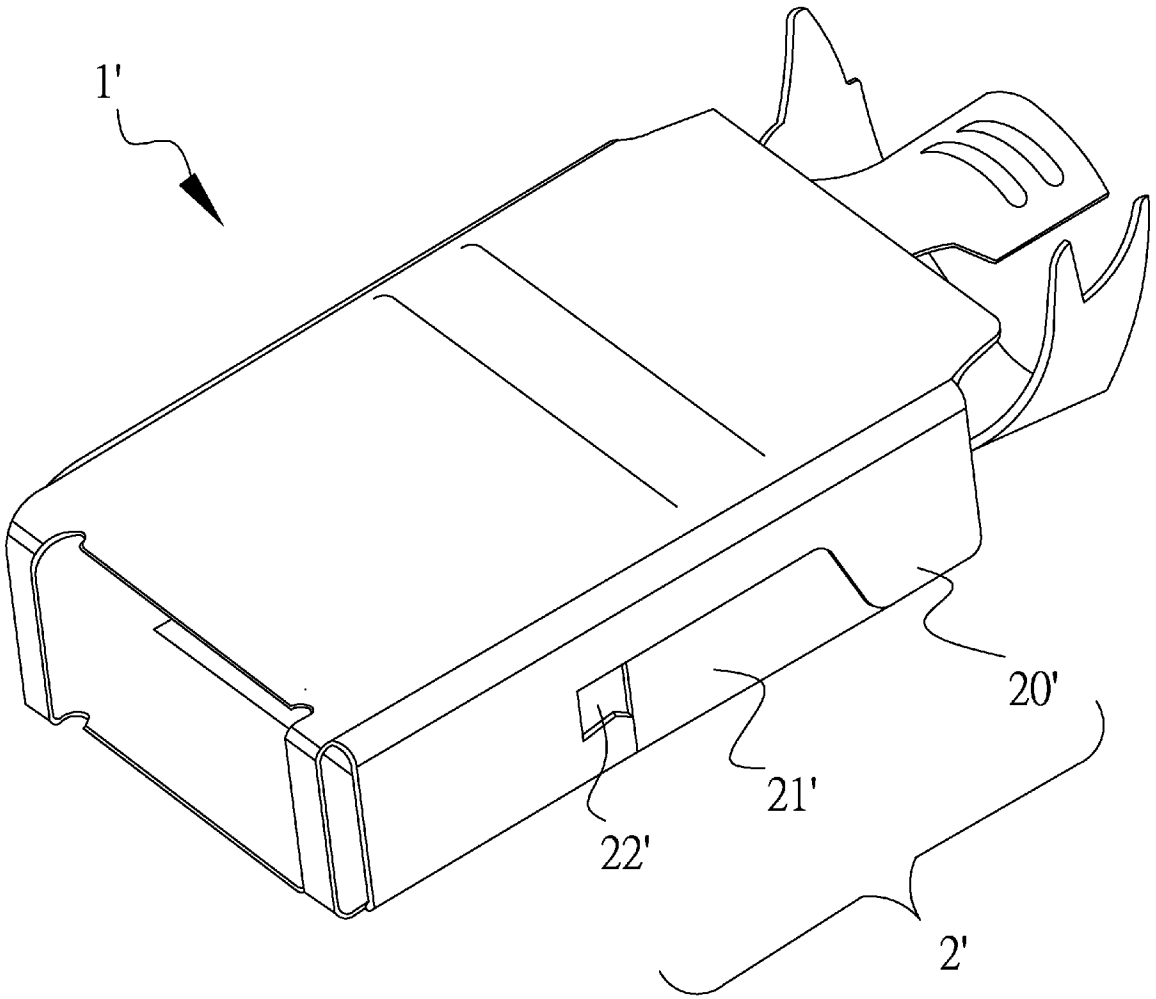
FIG. 8 is a perspective view illustrating a welding point between the circuit board and upper and lower housings of an embodiment electrically conductive housing.

A second embodiment is shown in FIGS. 7 and 8. The coupling device in this embodiment is a circuit board 6' having a front side 60', a back side 61' and two lateral sides 62' connecting the front side 60' to the backside 61'. Bonded onto a portion of the front side 60' and the back side 61', such as by laser welding or the like, are portions of flat sections 40' of two groups of resilient contact terminals 4', which are axially symmetrical to each other as shown in the first embodiment. The two groups of resilient contact terminals 4' are secured on the front side 60' and the back side 61' respectively, and so they maintain their axially symmetrical arrangement, and receive the flat sections 40', so as to prevent crossing of the flat sections 40 that may otherwise cause short circuiting.

The electrically conductive housing 2' also includes an upper housing 20' and a lower housing 21', each having a respective welding spots 22', and the welding spots 22' are formed in a manner corresponding to the two lateral sides 62' of the circuit board 6', so that the upper housing, the lower housing and the circuit board are welded together. In this way, the overall strength of the electrical connector plug 1' is improved. If the operator drops the electrical connector plug 1', the structure of the electrically conductive housing 2' will not be loosened or damaged due to the collision impact from hitting the ground.

Figure 9:
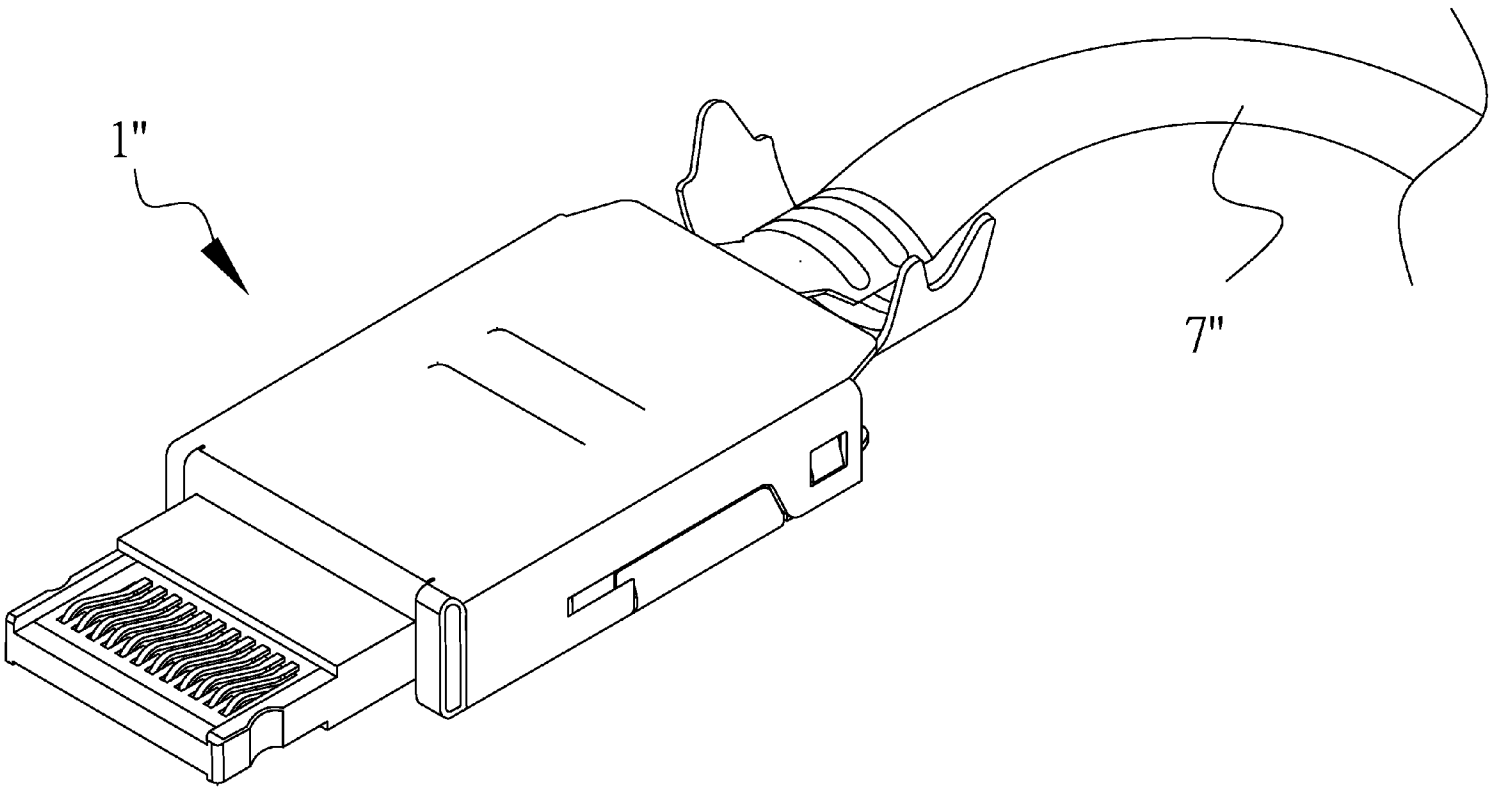
FIG. 9 is a perspective view of an electrical connector plug and conductive wire, and an assembly provided with the same, according to a third embodiment of the invention, illustrating connection between an electrical connector plug and related assemblies, such as conductive wires.

Those of reasonable skill in the art will readily understand that the electrical connector plug in any embodiment can work with the related modules simultaneously, such as the conductive wire. A third preferred embodiment provides a conductive wire adapted for the electrical connector, as shown in FIG. 9. As long as the circuit board (not shown in the figure) of the electrical connector plug 1" connects with the flat sections (not shown in the figure) of the resilient contact terminals (not shown in the figure) on one end, and connects with the electrically conductive wire 7" on the other end, it will form a conductive wire adapted for the electrical connector.

Various embodiments of the electrical connector plug and conductive wire, and an assembly provided with the same, allow the user to transmit files more easily. The user does not have to plug/unplug the electrical connector plug in a particular way. Whether it is plugged/unplugged in either orientation (up or down), the electrical connector plug can be connected/disconnected easily, which increases the convenience for use. Moreover, by mounting the resilient contact terminals on the electrical connector plug, together with the metallic shield frame, formed by metallic casting, and an electrical conductive section extending from the frame section of the metallic shield frame, manufacturing costs related to repeated processing are saved, resistance to pressure from external forces is increased, and the structural strength of the electrical connector plug is also increased, while reducing the probability of crosstalk. This structure changes the resilient contact terminals into consumable parts, so that users can change them by themselves, saving the time and expense spent of otherwise taking the host product in for repair.

While the invention has been described with reference to the preferred embodiments above, it should be recognized that the preferred embodiments are given for the purpose of illustration only and are not intended to limit the scope of the present invention, and that various modifications and changes, which will be apparent to those skilled in the relevant art, may be made without departing from the spirit and scope of the invention.

What is claimed is:

1. An electrical connector plug having resilient contact terminals and adapted for electrical connection to an electrical connector socket having a casing and at least two groups of engaging terminals mounted in the casing, the electrical connector plug comprising:

an electrically conductive housing;

a coupling device mounted in the electrically conductive housing and extending along a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part in the base portion of the coupling device and an upwardly protruding contact section extending from the flat section, wherein the flat sections are parallel to one another and the respective upwardly protruding contact sections are adapted to abut against at least a corresponding engaging terminal of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections have a height no less than that of the upwardly protruding contact sections of the resilient contact terminals, and wherein an electrically conductive section extends from the frame section towards the front section and is adapted for electrical connection to the casing of the electrical connector socket.

2. The electrical connector plug provided with resilient contact terminals according to claim 1, wherein the coupling device is a circuit board for electrical connection to the flat sections of the resilient contact terminals, and wherein the circuit board includes a front side, a back side and two lateral sides connecting the front side to the backside.

3. The electrical connector plug provided with resilient contact terminals according to claim 2, wherein the electrically conductive housing comprises an upper housing and a lower housing, each being formed at least a welded spot, and wherein each welded spot is formed in a manner corresponding to one of the two lateral sides of the circuit board, so that the upper housing, the lower housing and the circuit board are welded together.

4. The electrical connector plug provided with resilient contact terminals according to claim 1, wherein the height of each lateral protective section of the metallic shield frame is no less than that of the front section to provide protection to the upwardly protruding contact sections of the resilient contact terminals.

5. The electrical connector plug provided with resilient contact terminals according to claim 1, wherein the base portion of the coupling device is formed with a plurality of guide grooves to receive the flat sections of the resilient contact terminals.

6. The electrical connector plug provided with resilient contact terminals according to claim 1, wherein the plug is conformal to a universal serial bus plug.

7. The electrical connector plug provided with resilient contact terminals according to claim 1, wherein the metallic shield frame is produced by metallic casting, so that the electrical connector plug has improved structural strength.

8. A conductive wire for electrical connection to an electrical connector socket having a casing and at least two groups of engaging terminals mounted in the casing, the conductive wire comprising:

at least one electrical connector plug; and at least a wire electrically connected to the at least one electrical connector plug;

wherein the at least one electrical connector plug comprises:

an electrically conductive housing;

a coupling device mounted in the electrically conductive housing and extending in a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part to the base portion of the coupling device and an upwardly protruding contact section extending from the flat section, wherein the flat sections are parallel to one another and the respective upwardly protruding contact sections are adapted to abut against a corresponding one of the engaging terminals of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections each have a height no less than that of the upwardly protruding contact sections of the resilient contact terminals, and wherein an electrically conductive section extends from the frame section towards the front section and is adapted for electrical connection to the casing of the electrical connector socket.

9. An electrical connector assembly comprising:

an electrical connector socket comprising a casing and at least two groups of engaging terminals mounted in the casing; and an electrical connector plug electrically connectable to the electrical connector socket, comprising;

an electrically conductive housing;

a coupling device mounted in the electrically conductive housing and extending in a longitudinal direction, the coupling device comprising a base portion;

at least two groups of resilient contact terminals mounted in the coupling device and axially symmetrical to each other about the longitudinal direction, each of the resilient contact terminals comprising a flat section secured at least in part to the base portion of the coupling device and an upwardly protruding contact section extending from the flat section, wherein the flat sections are parallel to one another and the respective upwardly protruding contact sections are adapted to abut against at least one corresponding engaging terminal of the electrical connector socket; and a metallic shield frame electrically connected to and secured to the electrically conductive housing, the metallic shield frame comprising a frame section, a front section having two ends, and two lateral protective sections respectively extending from the two ends of the front section and connected to the frame section, wherein the respective lateral protective sections each have a height no less than that of the upwardly protruding contact sections of the resilient contact terminals, and wherein an electrically conductive section extends from the frame section towards the front section and is adapted for electrical connection to the casing of the electrical connector socket.

* * * * *